US005775707A

United States Patent [19]

Hu et al.

[11] Patent Number: 5,775,707

[45] Date of Patent: Jul. 7, 1998

[54] SKATE WHEEL FASTENING SYSTEM

[75] Inventors: Antonio Chung-Hua Hu, Menlo Park, Calif.; Albert Yiu-So Shum, Calgary, Canada

[73] Assignee: Primal Products, Inc., San Framcisco, Calif.

[21] Appl. No.: 601,690

[22] Filed: Feb. 15, 1996

[51] Int. Cl.[6] ..... A63C 17/06

[52] U.S. Cl. ..... 280/11.22; 280/11.27

[58] Field of Search ..... 280/7.13, 11.19, 280/11.2, 11.22, 11.23, 11.24, 11.25, 11.27; 301/1, 5.7, 111, 120, 121, 124.2

[56] References Cited

U.S. PATENT DOCUMENTS

| | | | |
|---|---|---|---|
| 576,106 | 2/1897 | Frankenberg et al. | 280/7.13 |
| 1,703,936 | 3/1929 | Jervoise | 280/11.23 |
| 1,733,059 | 10/1929 | Grinnen | 280/11.23 |
| 1,801,205 | 4/1931 | Mirick | 280/11.2 |
| 2,029,392 | 2/1936 | Ruske | 280/11.23 |
| 2,048,916 | 7/1936 | Bentzlin | 280/11.22 |
| 2,168,820 | 8/1939 | Edstrom | 280/11.23 |
| 3,807,761 | 4/1974 | Brilando et al. | 280/279 |
| 3,837,662 | 9/1974 | Marks et al. | 280/11.23 |
| 3,894,751 | 7/1975 | Fuhrman et al. | 280/279 |
| 3,963,252 | 6/1976 | Carlson | 280/11.22 |
| 4,146,241 | 3/1979 | Stevenson | 280/11.27 |
| 4,492,385 | 1/1985 | Olson | 280/7.13 |
| 4,666,169 | 5/1987 | Hamill et al. | 280/11.23 |
| 4,711,458 | 12/1987 | Shim | 280/11.22 |
| 4,805,941 | 2/1989 | Downing et al. | 280/279 |
| 5,048,848 | 9/1991 | Olson et al. | 280/11.22 |
| 5,068,956 | 12/1991 | Malewicz | 29/437 |
| 5,092,614 | 3/1992 | Malewicz | 280/11.22 |
| 5,165,762 | 11/1992 | Phillips | 301/110.5 |
| 5,190,301 | 3/1993 | Malewicz | 280/11.22 |
| 5,253,884 | 10/1993 | Landers | 280/11.27 |
| 5,271,633 | 12/1993 | Hill, Jr. | 280/11.22 |
| 5,277,437 | 1/1994 | Moats | 280/11.23 |
| 5,326,157 | 7/1994 | Nagano | 301/11 |
| 5,330,208 | 7/1994 | Charron et al. | 280/11.22 |
| 5,362,075 | 11/1994 | Szendel | 280/11.2 |
| 5,374,072 | 12/1994 | Landers | 280/11.27 |
| 5,383,716 | 1/1995 | Stewart et al. | 301/124.2 |
| 5,437,466 | 8/1995 | Meibock et al. | 280/11.22 |
| 5,441,286 | 8/1995 | Pozzobon . | |
| 5,447,362 | 9/1995 | Nagano | 301/111 |
| 5,464,235 | 11/1995 | Goldman et al. | 280/11.2 |
| 5,470,086 | 11/1995 | Peterson et al. | 280/11.22 |
| 5,595,392 | 1/1997 | Casillas | 280/11.27 |
| 5,603,519 | 2/1997 | Conte | 280/11.22 |
| 5,673,925 | 10/1997 | Stewart | 301/111 |

FOREIGN PATENT DOCUMENTS

| | | | |
|---|---|---|---|
| 92/10251 | 6/1992 | WIPO | 280/11.27 |

*Primary Examiner*—Brian L. Johnson
*Assistant Examiner*—Frank Vanaman
*Attorney, Agent, or Firm*—Limbach & Limbach L.L.P.

[57] ABSTRACT

A fastening system for attaching a wheel to the shoe portion of an in-line skate, which includes a pair of first and second opposing walls that depend from the shoe portion, each having a bottom edge. A pair of opposing slots formed in the walls, each having an open end at the bottom edges of the walls. A safety recess is formed on each of the first and second walls adjacent the slots. Two frame spacers each include a flange portion surrounding a raised shoulder plug. The plug and flange portions having a through-hole formed therethrough. Each of the flange portions have a safety protrusion formed thereon adjacent the plug. The plugs are inserted into the slots such that the safety protrusions removably engage the safety recesses. A wheel having an axle hole formed through its center of rotation is positioned between the pair of slots. An axle bolt is received through the axle hole of the wheel and the through-holes of the frame spacers for rotatably and removably securing the wheel between the walls of the frame.

16 Claims, 15 Drawing Sheets

SKATE WHEEL FASTENING SYSTEM

FIELD OF THE INVENTION

The present invention relates generally to in-line skates, and in particular to a wheel and frame assembly for removably fastening wheels to the skate.

BACKGROUND OF THE INVENTION

In-line skating has been one of the fastest growing sports in the U.S. for the past several years, with over 20 million participants in 1994. The sport has expanded to include roller hockey, aggressive skating, speed skating, fitness skating, figure skating, and recreational skating.

Nearly all in-line skates use wheels made of polyurethane or a similar material. These wheels wear down due to abrasion against the skating surface. Eventually wheel wear will negatively affect skating speed, maneuverability and control, at which point the wheels need replacing. Due to the lateral stride of the skating motion, wheels typically wear unevenly, with more wear occurring toward the inside of the skate. Depending upon the skater's stride, the individual wheels on each skate may also wear unevenly, such as the front and back wheels wearing faster than the center wheels. For maximum performance, wheels should be rotated periodically to correct for this uneven wear. Such rotation includes flipping the wheels so that the inside surface faces outwardly, as well as swapping wheel positions. Occasionally, wheels will break before excessive wear occurs, which also requires wheel replacement.

Currently, replacing or rotating wheels is very time-consuming. In-line skates typically have four wheels per skate. Each wheel is held in place by one or two threaded bolts which extend through the central axis of the wheel and through axle holes on either side of the skate frame. To remove a typical wheel assembly, a wrench must be used to hold one bolt in place while another wrench is used to unscrew the opposing bolt. With one bolt removed, the first wrench is then inserted into the wheel spacer to prevent its rotation while the other bolt is unscrewed by the second wrench. With both bolts removed, the wheel can then be removed from the frame. When installing wheels, the bolts must be inserted through the axle holes and then manipulated until they mate into the wheel spacer. This procedure is made more difficult by the visual obstruction created by the frame, and the fact that the wheel spacer freely spins. Changing all eight wheels can take twenty or thirty minutes depending on the fastening system. Further, after the wheels are removed there are loose parts, such as the bolts, nuts, etc., that can be lost or misplaced during the wheel changing process.

Avid skaters rotate their wheels quite frequently. In fact, it is not unusual for roller hockey players to rotate their wheels after every two hours of play. Therefore, there are several prior art devices that have employed different techniques to reduce the excessive time required to change and/or rotate in-line skate wheels. For example, U.S. Pat. No. 5,068,956 shows a captured nut design to allow wheel-removal with one tool. However, the bolt still must be unscrewed and removed. Further, the user must keep track of the bolts, nuts, and wheels during the wheel changing process. Lastly, the design makes use of additional parts which complicate the wheel-changing process and add to manufacturing costs.

The skate frame disclosed in U.S. Pat. No. 2,168,820 uses notches for the reception of the wheel axles. The axles are secured by nuts which are engaged in large recesses to prevent the axles from dropping out of the notches. While this system allows for simplified wheel removal, the use of recesses to secure the nuts relative to the notches has several significant disadvantages. First, it appears to take two tools to loosen both the bolts. Secondly, it is difficult to get the tool properly engaged with a nut that is partially sunken into a recess. Third, the notch is filled only by the axles, which results in a limited surface area for the nut to hit when tightened, and an increase in the movement of the wheel and axle if the axle is slightly loosened. Fourth, the proximity of the recesses to the bottom edge of the frame exposes the walls defining the lower end of the recess to abrasion against the skating surface. Damage to the recesses may result in the axles unintentionally dropping out of the notches, because the abrasion prone bottom edges of the frame form the critical portion of the recess that maintains the nut above the notch opening. Lastly, the thickness of the frame is reduced where the recesses are formed into the frame, which may create structural weaknesses at the critical mounting point of the axles.

U.S. Pat. No. 1,733,059 shows another skate with slots for holding the axles. Retaining means are provided which screw into the frame and which fill the gap in the slot below the axle after the axle is secured to the frame. While this retaining means prevents the axle from falling out, the removal of the wheels still requires removal of the retaining means, including removal of the screws.

The skate frame described in U.S. Pat. No. 1,801,205 also employs notches or slots to hold the axles. Longitudinal retaining bolts passing through eyelets formed near the bottom of the slots are used to hold the axles in place. These longitudinal bolts must be removed before the wheels can be removed. Further, the placement of retaining bolts near the bottom edge of the frame exposes them to abrasion and damage. Lastly, the retaining bolts may add unnecessary weight to the frame.

U.S. Pat. No. 3,963,252 shows a skate with a complex arrangement of springs, rods, and slots to facilitate wheel removal. This design would likely result in increased weight and complexity, reduced frame strength, and decreased axle stability. An alternate embodiment uses plates fastened along the bottom edge of the frame to secure the axles in the slots. Their placement makes the plates susceptible to damage, and these plates must be removed before removal of the wheels.

U.S. Pat. Nos. 5,330,208 and 2,029,392 show skates which use retaining members and plates fastened across slot openings to secure the axles in place. These plates must be removed before the wheels can be removed.

U.S. Pat. No. 3,837,662 describes a skate with axles held in slots by resilient keepers welded to the side wall of the frame. Removal of the wheels requires the keepers to be pried apart, requiring additional tools and adding time to the wheel changing/rotating procedure.

Several of the designs referenced here have the additional disadvantage of not allowing the user to tighten the frame directly against the wheel bearings. This results in play between the frame and the wheel which will cause vibration and instability.

U.S. Pat. No. 5,048,848 show dual-position, eccentric axle aperture plugs which allow the wheels to be "rockered". The plugs mate into and are retained by axle apertures in the frame, thereby preventing movement of the plugs during wheel installation. Many skaters "rocker" their wheels to increase maneuverability for short turns. "Rockering" results in some wheels, for example the center wheels, protruding from the skate frame further than the rest of the wheels. Rockering can also be done to even out a worn wheel of reduced size with the rest of the wheels. The problem with the "rocker" design of the '848 patent is that the bolt must be completely removed to remove the wheel from the skate frame, resulting in loose bolts, plugs, nuts etc. that may can lost or misplaced. Further, to change the rocker configuration, the plugs must be individually removed from the frame (after the wheels have been removed), turned upside-down, and then replaced into the frame.

There is a need for a simple and inexpensive in-line skate frame and wheel assembly that allows for quick and convenient removal and replacement of the wheels without having to fully remove the bolts or other parts from the wheel assembly. There is also a need for such a frame and wheel assembly that allows such removal with a single tool. Further, since such skate wheels can be changed/rotated at the playing site, there is a need for the wheel assembly to remove from the skate frame in unit form, such that no additional or unattached parts are necessary that could be lost or misplaced during the wheel changing process. Lastly, there is a need for a fastening system which minimizes play between the wheel assembly and the frame by applying compression to the wheel assembly between the frame walls, while not using fasteners susceptible to damage due to contact with the skating surface.

SUMMARY OF THE INVENTION

The aforementioned problems are solved by the wheel fastening system of the present invention, which rotatably secures wheels to a shoe portion of an in-line skate. The entire wheel assembly of the present invention quickly and easily removes from the skate frame as a single unit, so there are no small parts to keep track of or lose. The wheel assembly can be removed using a single tool, and it facilitates "rockering" of the wheels. The wheel fastening system of the present invention also minimizes play between the wheel and the frame.

The fastening system of the present invention includes a frame attached to a bottom surface of the shoe portion that includes a pair of first and second opposing walls that depend from the shoe portion. Each of the walls has a bottom edge. A pair of opposing slots is formed in the walls, each having an open end at the bottom edges of the walls. A first engagement means is formed on each of the walls adjacent the slots. Two frame spacers each have a plug with a flange portion extending therefrom. The plug has a through-hole formed therethrough and is dimensioned to insert into the slot. Each of the frame spacers has a second engagement means formed on the flange portion. The frame spacers insert into the slots such that the first engagement means removably engages the second engagement means for removably securing the first and second spacers to the frame. A wheel having an axle hole formed through its center of rotation is positioned between the pair of slots. An axle means is received through the axle hole of the wheel and the through-holes of the frame spacers for rotatably and removably securing the wheel between the first and second walls of the frame.

In another aspect of the present invention, the slots have an open end at the bottom edges of the walls, and safety recesses formed inside the slots. First and a second frame spacers are dimensioned to insert into the slots and include a through-hole formed therethrough. Each of the frame spacers have a pair of protrusions that extend therefrom such that when the plugs are inserted into the slots the protrusions removably engage the safety recesses. A wheel having an axle hole formed through its center of rotation is positioned between the pair of slots. An axle means is received through the axle hole of the wheel and the through-holes of the frame spacers for rotatably and removably securing the wheel between the first and second walls of the frame.

In still another aspect of the present invention, a snap recess formed adjacent a closed end opposite the open end of each of the slots. An axle means having a shaft that snaps into one of the snap recesses in one of the slots engages the wheel axle hole, wherein the snap recesses removably secure the axle means in the slots.

In yet another aspect of the present invention, each of the walls has one of a safety recess and a safety protrusion formed therein adjacent the slots. A wheel having an axle hole formed through its center of rotation is positioned between the pair of slots. A bolt having a bolt head and a threaded shaft extends through the slots and the axle hole. A threaded nut engages the threads of the bolt, wherein the other of the safety recess and the safety protrusion is formed on one of the bolt head and the nut positioned to engage the one of the safety recess and the safety protrusion on the wall to removably secure the wheel to the frame.

Other objects and features of the present invention will become apparent by a review of the specification, claims and appended figures.

DETAILED DESCRIPTION OF THE PREFERRED EMBODIMENTS

Figure 1A:
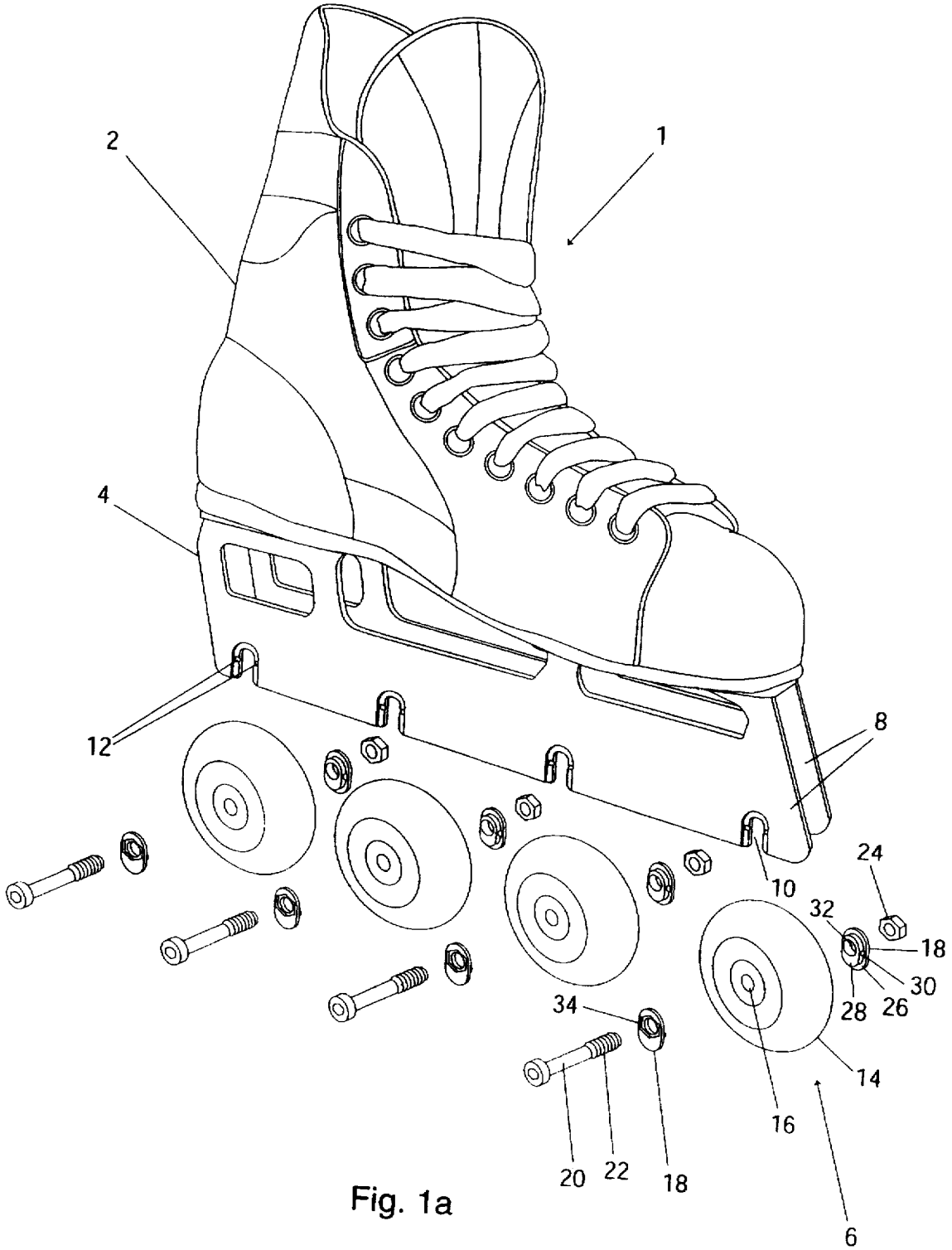
FIGS. 1*a*–1*b* are exploded perspective views of a wheel fastening system of the present invention.
Figure 1B:
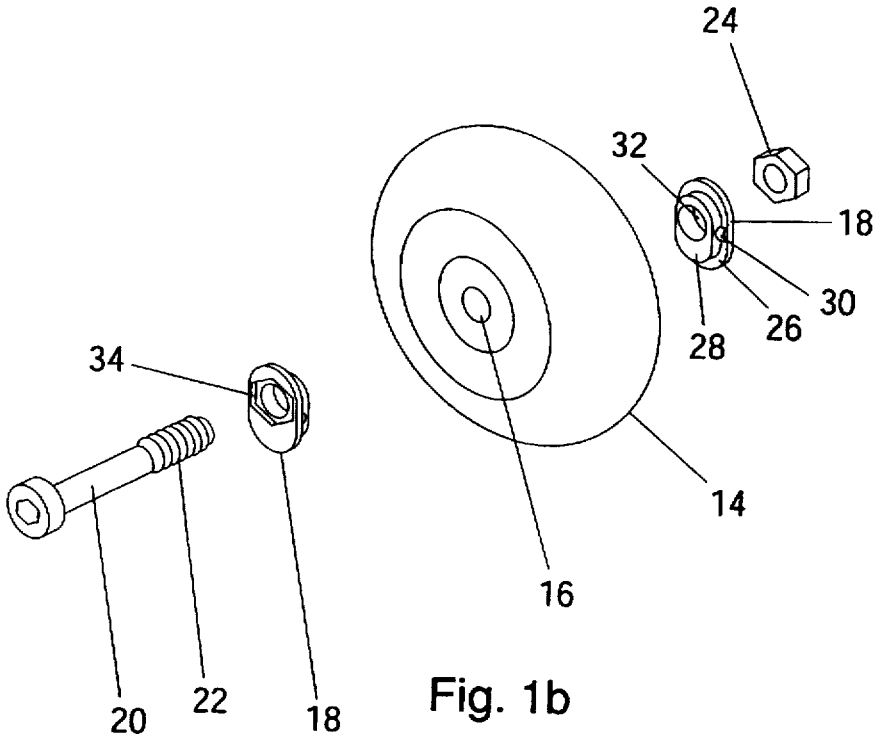
Figure 1C:
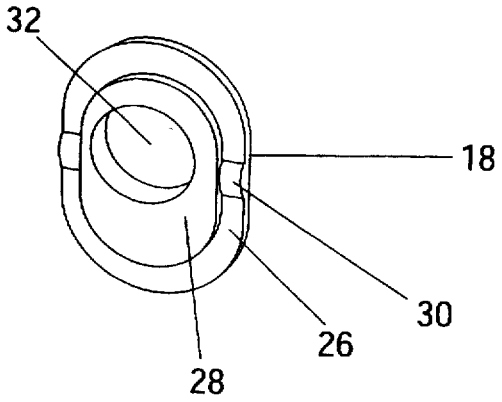
FIG. 1*c* is a perspective view of the frame spacer used in the wheel fastening system.

An in-line skate 1 of the preferred embodiment of the present invention is shown in FIGS. 1*a*–1*c*. The in-line skate 1 has a boot portion 2, a frame 4 attached to the bottom of the boot portion 2, and a plurality of wheel modules 6.

The frame 4 is made of extruded and machined aluminum, molded plastic, or other sturdy materials. The frame 4 includes two substantially vertical walls 8 generally parallel to one another and spaced apart to accept wheel modules 6 between them. A plurality of slots 10 are spaced along the bottom edge of the walls 8. A pair of safety recesses 12 are located in the outer surface of each wall 8 adjacent each slot 10.

Each wheel module 6 includes a wheel 14 having an axle hole 16 through the center thereof, a pair of frame spacers 18, an axle bolt 20 having a threaded shaft 22, and a hexagonal nut 24. Each frame spacer 18 includes a flange portion 26 surrounding a raised annular shoulder plug 28 formed on one side of the frame spacer 18. A pair of safety protrusions 30 are formed on the flange 26, one on each side of plug 28. The protrusions 30 are dimensioned to engage recesses 12 of frame 4. A frame spacer through-hole 32 is formed in frame spacer 18 through annular plug 28 and flange portion 26 to the opposite side of frame spacer 18. A hexagonal recess 34 is formed on the opposite side of frame spacer 18 and is centered around through-hole 32. Plug 28 is non-cylindrical and centered with respect to flange 26. Through-hole 32 is eccentrically located with respect to plug 28.

To attach the wheel module 6 to the frame 4, wheel 14 is placed inside walls 8 such that axle hole 16 lines up with one pair of the slots 10. Two frame spacers 18 are placed on the outside of walls 8, one frame spacer 18 on each side of frame 4, such that flanges 26 abut the outside surfaces of walls 8, protrusions 30 engage recesses 12, and plug 28 engages slot 10. Bolt 20 inserts into through-holes 32 and axle hole 16. Plugs 28 fit into the slots 10 filling in the space between the axle bolt 20 and the frame 4 so that frame spacers 18 do not move relative to the frame 4 during use. Nut 24 screws onto threaded shaft 22 of bolt 20 by rotating bolt 20 with a wrench or screw driver such that nut 24 engages hexagonal recess 34, which prevents nut 24 from rotating with bolt 20.

With the wheel module 6 mounted in the frame 4, the frame safety protrusions 30 mate into the safety recesses 12 thereby preventing the wheel module 6 from falling out of the frame 4 should the axle bolt 20 and nut 24 accidentally loosen. Plug 28 is non-cylindrical to prevent rotation thereof in the slot 10.

To intentionally remove the wheel module 6 from the frame 4, bolt 20 is rotated to loosen nut 24 until protrusions 30 disengage from the safety recesses 12. The wheel module 6 may then be pulled out of the slot 10 as a single unit. The hexagonal recess 34 in the frame spacer 18 prevents rotation of the nut 24, thereby allowing the threading and unthreading of nut 24 on bolt 20 with the use of only a single tool. The wheel module 6 removes from frame 4 as a unit for quick removal and replacement, and with no loose parts to keep track of or lose.

The wheel module 6 is easily reinserted into slots 10 as a unit by lining up the frame spacers 18 to the slots 10 so that protrusions 30 engage recesses 12 and plugs 28 engage slots 10. Tightening bolt 20 then secures wheel module 6 to frame 4.

Two vertical positions of bolt 20 relative to frame 4 can be achieved by rotating the frame spacers 18 about bolt 20 by 180° before insertion of the wheel module 6 in slots 10. The two vertical positions result from the eccentrically located through-holes 32 in frame spacers 18. Therefore, the height of the whole wheel module 6 relative to the frame 4 may be adjusted between these two vertical positions for different "rocker" positions when wheel module 6 is attached to frame 4. "Rockering" results in some wheels, for example the center wheels, protruding from the skate frame 4 further than the rest of the wheels. This results in better maneuverability. "Rockering" can also be used to even out a worn wheel of reduced diameter with the rest of the wheels.

Figure 2A:
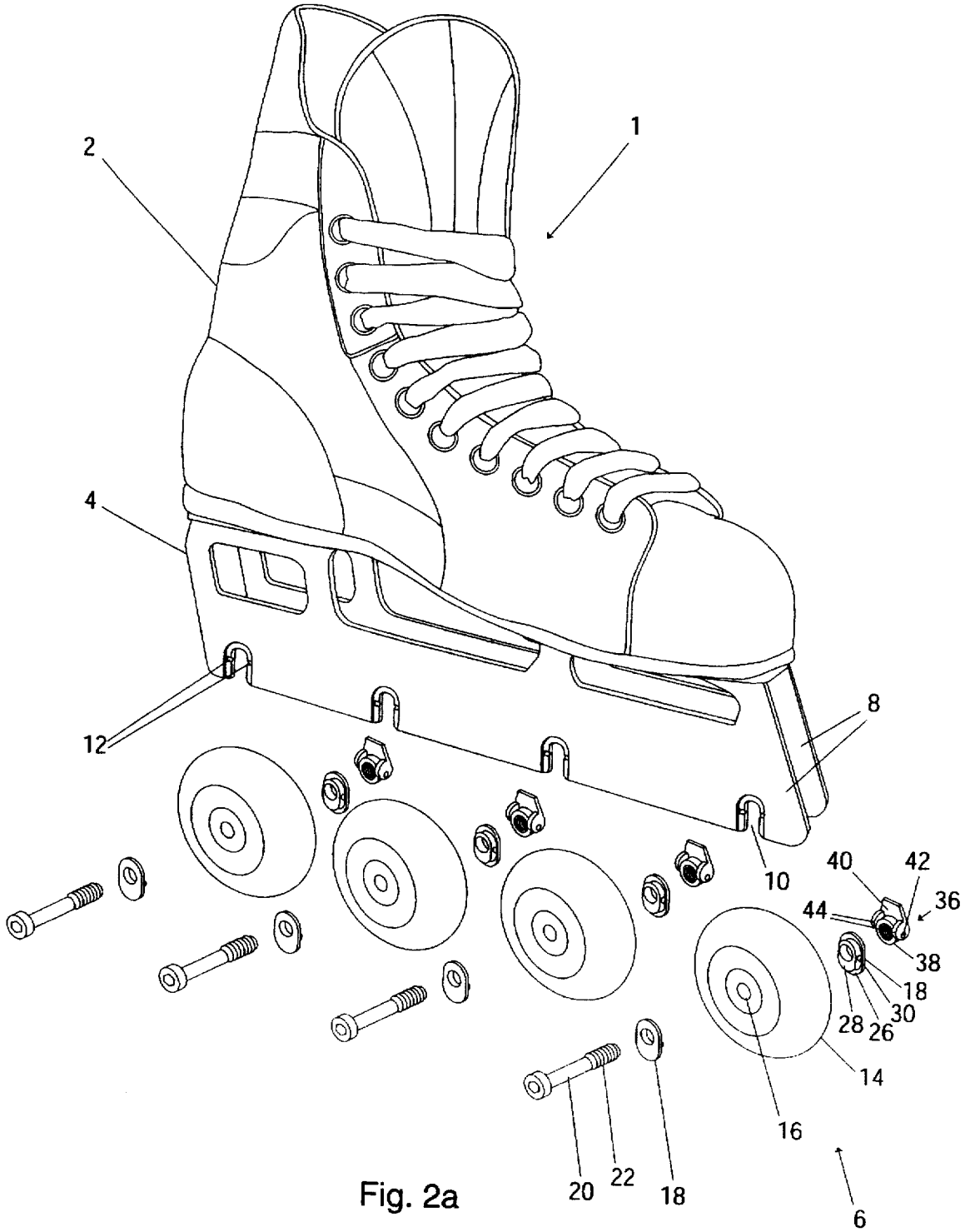
FIGS. 2*a*–2*b* are exploded perspective views of the wheel fastening system with cam nuts secured to the end of the bolt.
Figure 2B:
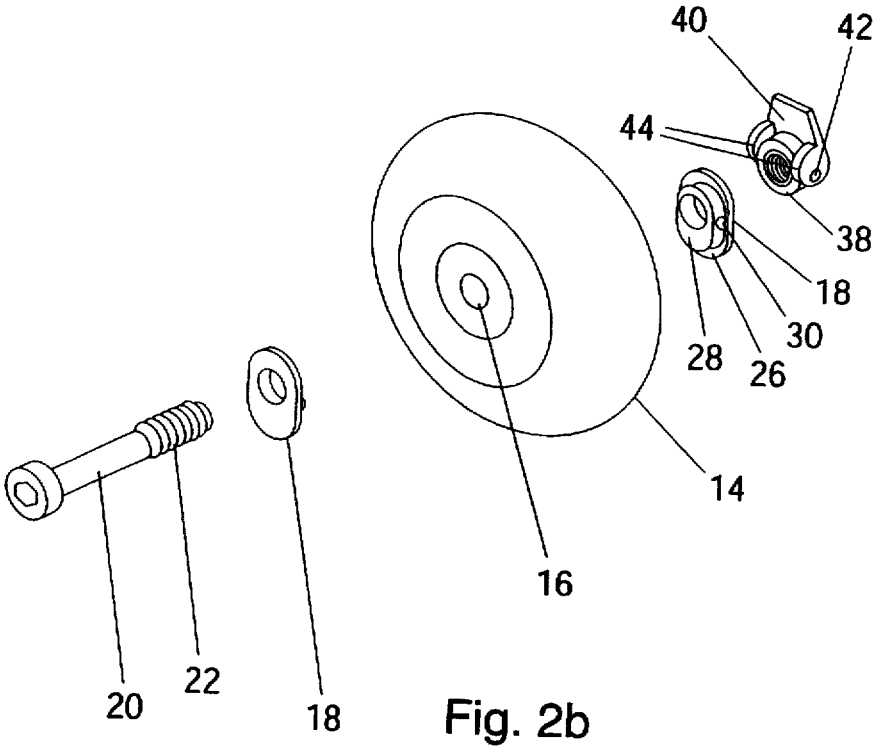
Figure 2C:
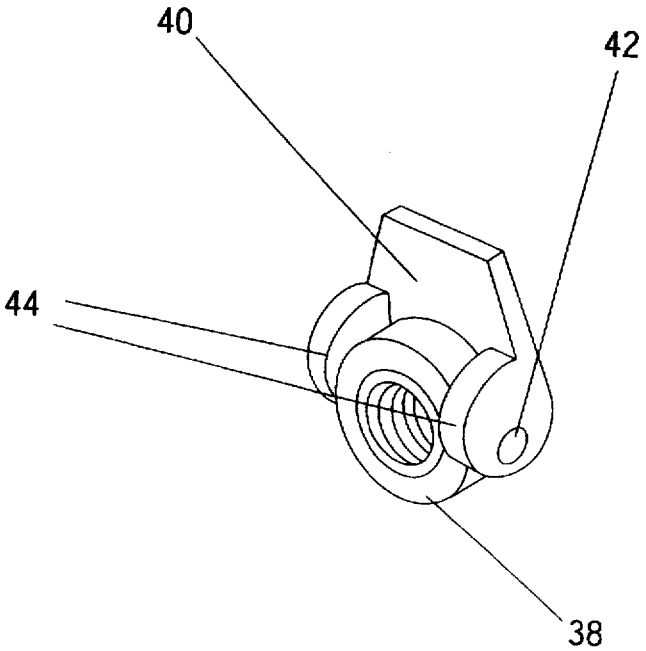
FIG. 2*c* is a perspective view of the cam nut.

FIGS. 2*a*–2*c* illustrate a second embodiment of the present invention. This second embodiment is similar to the first embodiment described above, except cam nuts 36 are used in place of the hexagonal nuts 24, and the hexagonal recesses 34 are eliminated from the frame spacers 18. Each cam nut 36 is comprised of a threaded nut portion 38 and a lever 40 rotatably connected thereto via a cam pin 42. Lever 40 pivots between an open and a closed position where the lever 40 is parallel and perpendicular, respectively, to bolt 20. Lever 40 includes cam lobes 44 that extend below nut portion 38 when lever 40 is in its closed position.

To mount the wheel module 6 to the frame 4, the wheel module 6 is inserted into the slots 10 such that safety protrusions 30 are mated into the safety recesses 12. The cam nut lever 40 is positioned in its extended open position while cam nut 36 is threaded onto bolt 20 until it rests against the frame spacer 18. Cam lever 40 is then pivoted 90° to its flat closed position, where cam lobes 44 exert pressure on frame spacer 18 which tightens the cam nut 36 and axle bolt 20 against the frame spacers 18 and the frame 4. The cam nut 36 is designed to be bi-stable to prevent it from disengaging when the lever 40 is in its closed position. In the event the cam nut 36 loosens, the safety protrusions 30 engaged in safety recesses 12 prevent the wheel module 6 from accidentally falling out of the slots 10.

Frame spacers 18 illustrated in FIGS. 1*a*–*c* and 2*a*–*c* have flange portions 26 that completely surround plug 28. While this configuration provides a very stable wheel fastening system, it is not necessary for flange portion 26 to completely surround plug 28. It is only critical that flange portions 26 extend away from the sides of plugs 28 thereby having a width that is larger than the width of slot 10 to provide sufficient space for forming safety protrusions or safety recesses thereon.

Figure 3A:
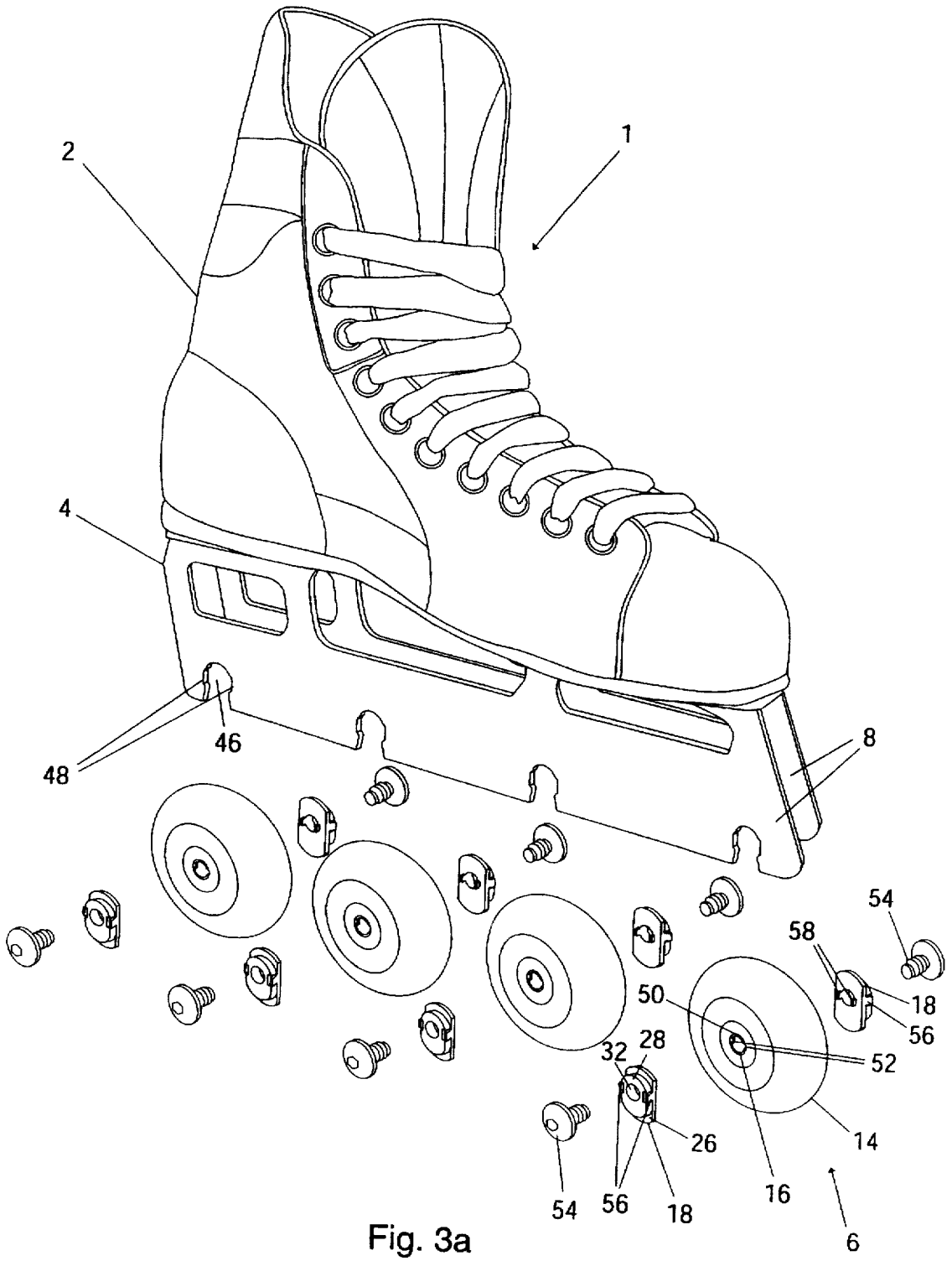
FIGS. 3*a*–3*b* are exploded perspective views of the wheel fastening system that has safety recesses formed inside the slots.
Figure 3B:
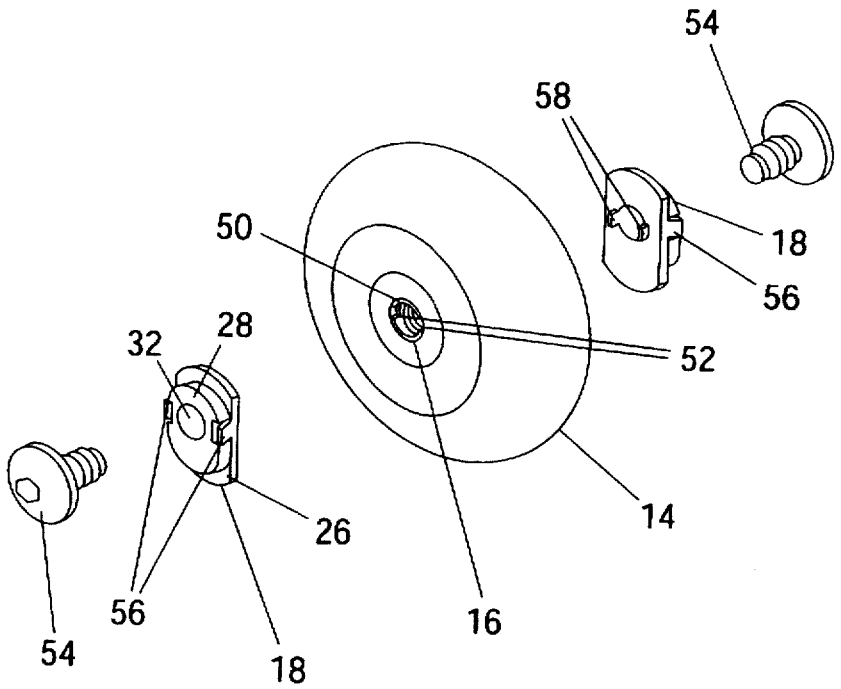
Figure 3C:
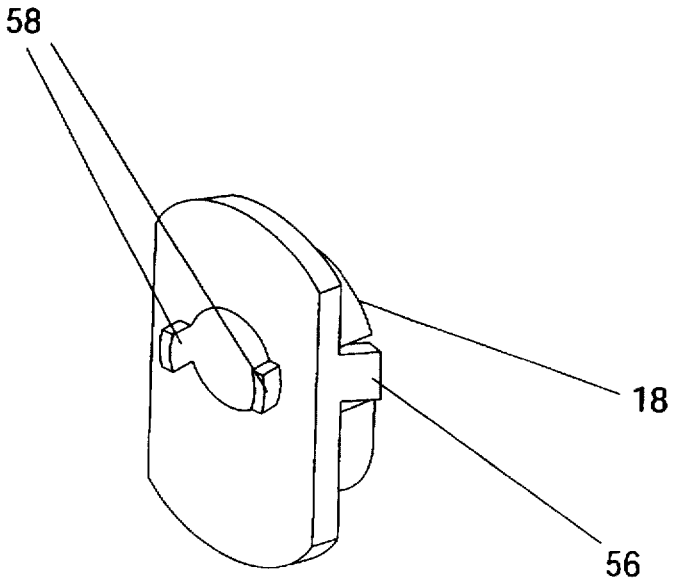
FIG. 3*c* is a perspective view of the frame spacer with index tabs.

FIGS. 3*a*–3*c* illustrate third embodiment of the present invention. In this embodiment, frame 4 includes shaped slots 46 that have safety recesses 48 formed in the sides of each of the slots 46.

Wheels 14 each include a threaded wheel spacer 50 formed in axle hole 16. Indexing recesses 52 are formed on both sides of the wheel spacer 50. A pair of threaded bolts 54 insert through each of the pair of frame spacers 18 to engage the threaded wheel spacer 50.

Each frame spacer 18 has a flange portion 26 extending from a raised annular shoulder plug 28 formed on one side of the frame spacer 18. The shoulder plug 28 is dimensioned to insert into one of the slots 46 of frame 4. A pair of snap protrusions 56 are formed on the flange 26, one on each side of plug 28, and extend out along the sides of shoulder plug 28. The snap protrusions 56 are flexible and dimensioned to engage the safety recesses 48 of slots 46. Through-hole 32 is formed in frame spacer 18 through annular plug 28 and flange portion 26 to the opposite side of frame spacer 18. Plug 28 is non-cylindrical and centered with respect to flange 26. Through-hole 32 is eccentrically located with respect to plug 28. Indexing tabs 58 are formed on the opposite surface of frame spacer 18 than plug 28, and are dimensioned to engage the indexing recesses 52 in the wheel spacer 50.

In this embodiment, each pair frame spacers 18 slide vertically upwards into slots 46 such that both plugs 28 face away from each other, and flanges 26 abut the inside surfaces of walls 8. As each frame spacer 18 is inserted vertically into a slot 46, snap protrusions 56 bend inwardly due to the narrowing sides of slots 46 until snap protrusions 56 reach and expand into safety recesses 48, thus locking the frame spacers 8 into slots 46. When the wheel module 6 is fully assembled, indexing tabs 58 engage indexing recesses 52 formed in the wheel spacer 50. The plug 28 is non-cylindrical to prevent rotation in the slot 46. In addition, through-hole 32 is eccentrically located in the plug 28 to provide two heights of the wheel module 6 relative to the frame 4 for "rockering" purposes.

The indexing tabs 58 on the frame spacers 18, and indexing recesses 52 in the wheel spacers 50, serve two functions. When the indexing tabs 58 are engaged with the indexing recesses 52, the two frame spacers 18 will maintain the same orientation relative to one another. This simplifies the task of mounting the wheel module 6 to the frame 4 by eliminating the need to first align both frame spacers 18 before inserting them into the slots 46. Such indexing also prevents rotation of the wheel spacer 50 relative to the frame 4 so that both axle bolts 54 can be loosened or tightened with a single tool for removal/replacement of the wheel module 6. Without this indexing feature, after loosening one axle bolt 54, the other axle bolt 54 would remain fastened to and rotate with the wheel spacer 50.

Figure 3D:
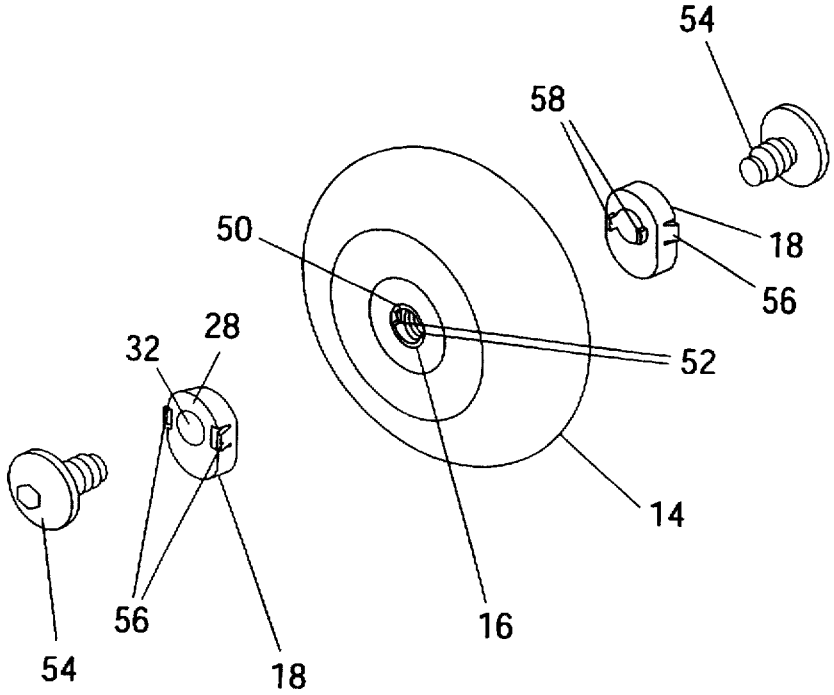
FIG. 3*d* is an exploded perspective view of a frame spacer without a flange portion.

It should be evident that the frame spacers 18 can be designed with flanges 26 formed on the opposite side of the shoulder plugs 28, such that the flanges 26 abut the outer surfaces of frame walls 8. Further, frame spacers 18 can be designed without any flange portions 26, as illustrated in FIG. 3*d*, where snap protrusion 56 are formed directly on the sides of shoulder plugs 28.

The use of two axle bolts 54 and threaded wheel spacers 50 has several advantages. First, it minimizes play in the wheel assembly, because bolts 54 directly thread into wheel spacer 50, which securely holds wheel 14 relative to frame 4. Secondly, there is no nut protruding from the wheel module 6, which damages more easily than a bolt head. Lastly, there is no threaded end of a bolt extending out of the frame walls 8, which can be damaged or stripped when contacting the playing surface.

With the wheel module 6 mounted in the frame 4, the snap protrusions 56 mate into the safety recesses 48 thereby preventing the wheel module 6 from falling out of the frame 4 should one or both axle bolts 54 accidentally loosen. To intentionally remove the wheel module 6 from the frame 4, axle bolts 54 are loosened, at which point the wheel module 6 may then be pulled vertically downward to disengage snap protrusions 56 from safety recesses 48, such that wheel module 6 is removed from frame 4 as a single unit. To remount the wheel module 6 to the frame 4, the wheel module 6 is pushed vertically back into the slots 46 thereby engaging the frame spacer snap protrusions 56 into the safety recesses 48, and the axle bolts 54 are then tightened into the wheel spacer 50. The force needed to disengage the snap protrusions is great enough to prevent the wheel from accidentally falling out while being small enough to allow manual removal of the wheel assembly.

Figure 3E:
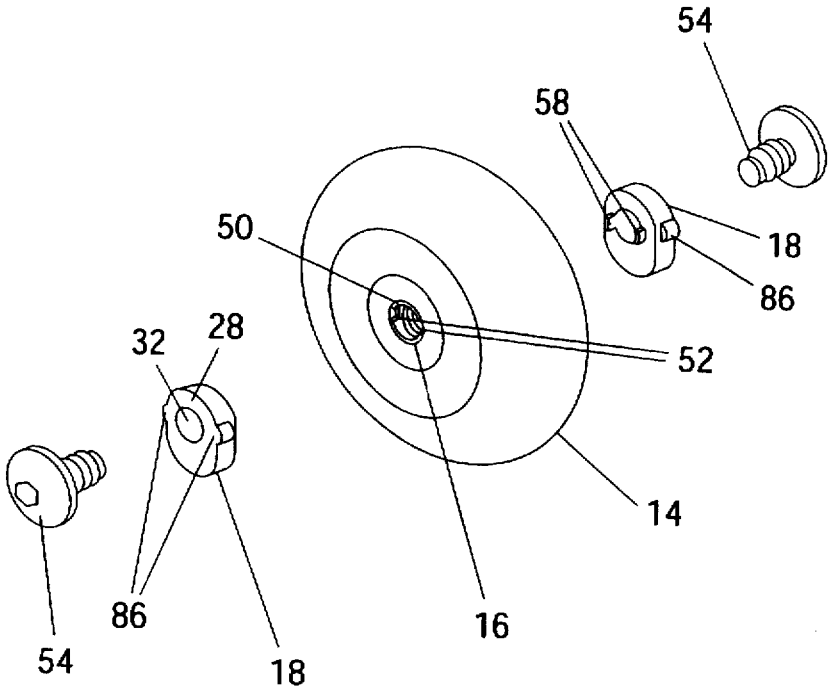
FIG. 3*e* is an exploded perspective view of a frame spacer with rigid protrusions.

An alternate embodiment to the flexible snap protrusion plugs of FIGS. 3*a*–3*d* is illustrated in FIG. 3*e*, which instead uses rigid protrusions 86 formed on the sides of plugs 28. With rigid protrusions 86, even excessive force downward would not dislodge frame spacers 18 from slots 46. Instead, frame spacers 18 could only be removed when bolts 54 are sufficiently loosened to allow frame spacers 18 to move horizontally out (away from wall 8) until rigid protrusions 86 fully disengage from safety recesses 48 in slot 46.

Figure 4A:
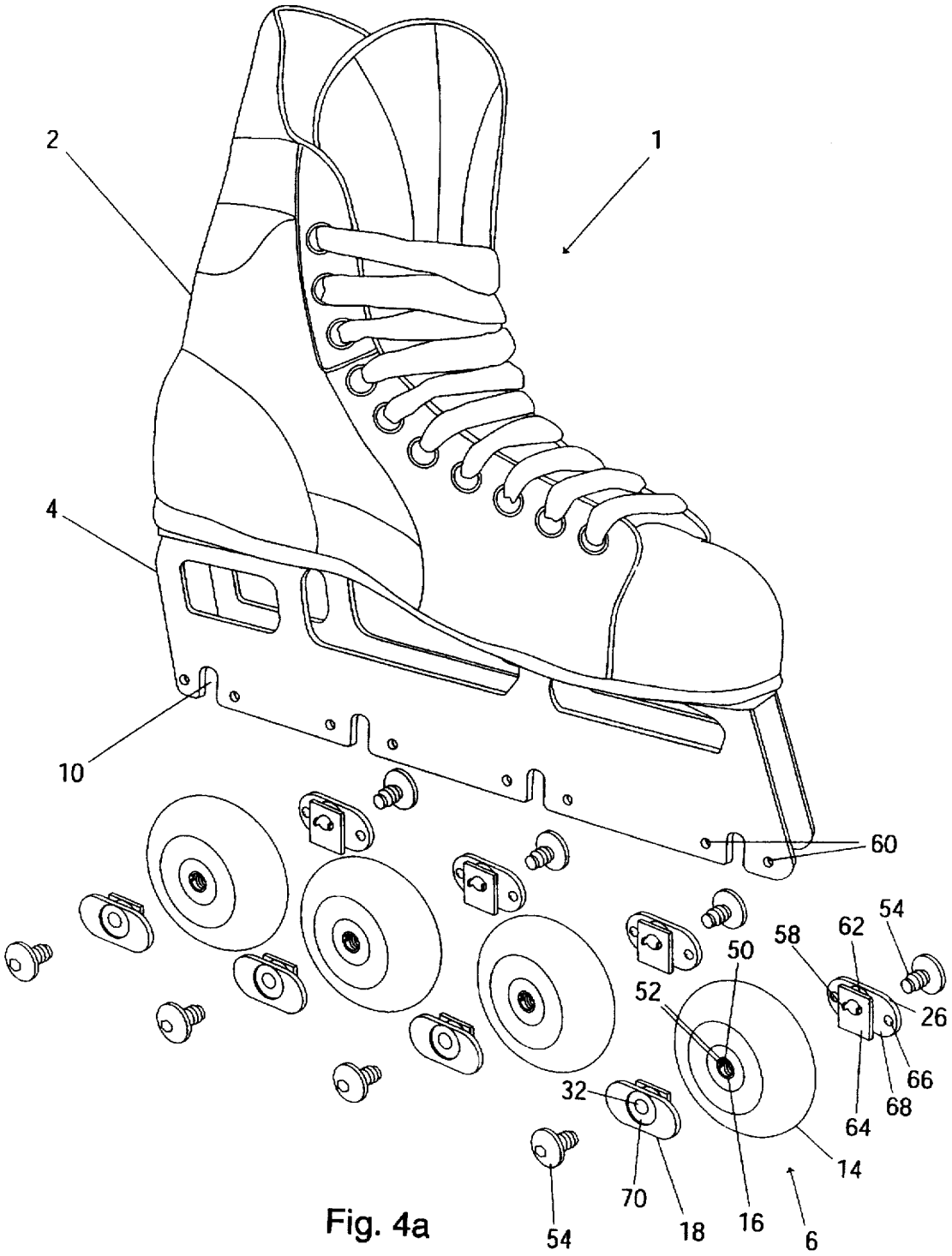
FIGS. 4*a*–4*b* are exploded perspective views of the wheel fastening system that utilizes frame spacers with collars.
Figure 4B:
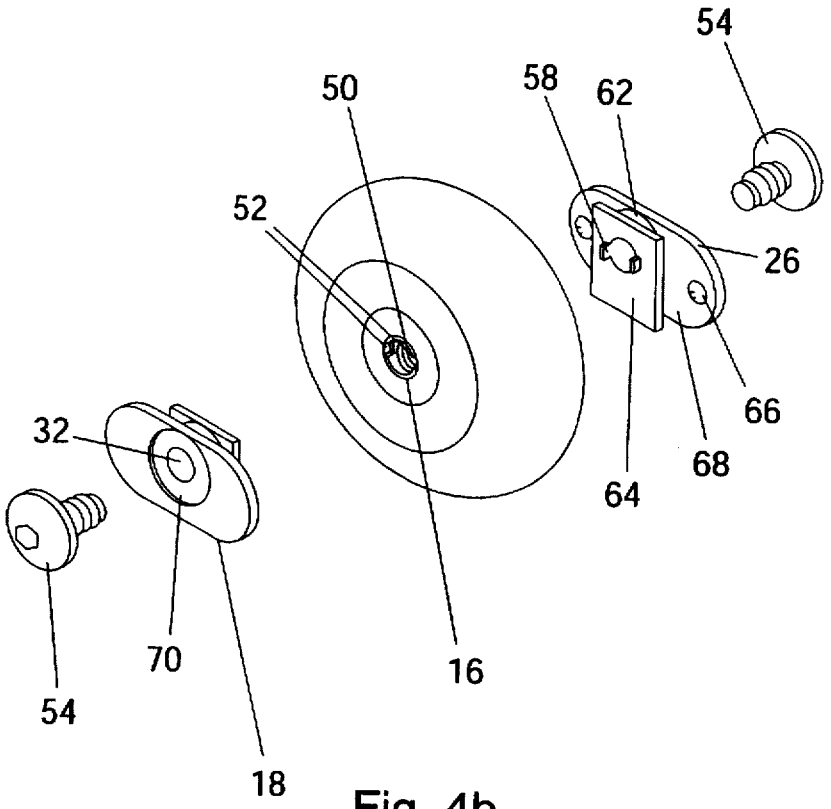
Figure 4C:
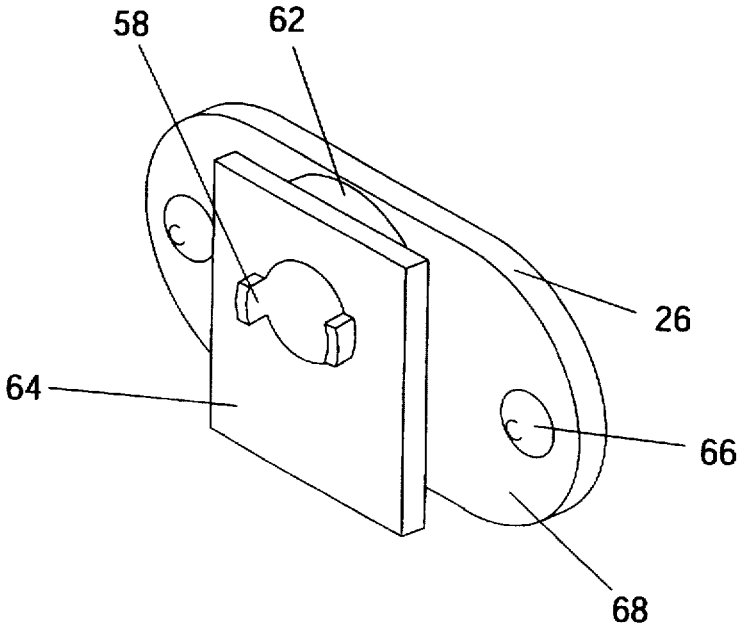
FIG. 4*c* is a perspective view of the frame spacer with the collar.

FIGS. 4*a*–4*c* illustrate a fourth embodiment of the present invention. A pair of safety recesses 60 are formed on the outside of walls 8 adjacent to each slot 10. The frame spacers 18 of this embodiment include a plug 62 with a flange portion 26 at one end and a collar 64 at the other end. The collar 64 shown in FIGS. 4*a*–4*c* is rectangular shape, but any shaped collar will suffice so long as it has a width that is larger than the width of the slot 10. Plug 62 is dimensioned to fit into one of the slots 10, where the flange portion 26 abuts the outside surface of wall 8 and the collar 64 abuts the inside surface of wall 8. Safety protrusions 66 are formed on arms 68 of flange portions 26 and are dimensioned to mate into safety recesses 60. Through-hole 32 extends through flange portion 26, plug 62 and collar 64. A circular recess 70 is formed around through-hole 32 in the flange surface opposite to plug 62 for receiving the head of bolt 54. Indexing tabs 58 extend out of the inside facing surface of collar 64 for mating with indexing recesses 52 in the wheel spacer 50.

In this embodiment, the plug 62 is non-cylindrical to prevent its rotation in the slot 10. In addition, through-hole 32 is eccentrically located in the plug 62 for "rockering" the wheels 14 in the frame 4.

With the wheel module 6 mounted in the frame 4, safety protrusions 66 mate into the safety recesses 60 thereby preventing the wheel module 6 from falling out of slot 10 should the axle bolts 54 accidentally loosen. To intentionally remove the wheel module 6 from the frame 4, the axle bolts 54 are loosened so that the wheel module 6 may then be pulled vertically downwards out of the slots 10. When the wheel module 6 is pulled downward, the force on the frame spacer 18 causes flange arms 68 to bend away from wall 8 such that the to safety protrusions 66 will disengage from the safety recesses 60. To re-mount the wheel module 6 to the frame 4, the wheel module 6 inserts vertically upwards into the slots 10 until the safety protrusions 66 engage into the safety recesses 60. Tightening axle bolts 54 into the wheel spacer 50 securely fastens wheel module 6 to frame 4.

Figure 5A:
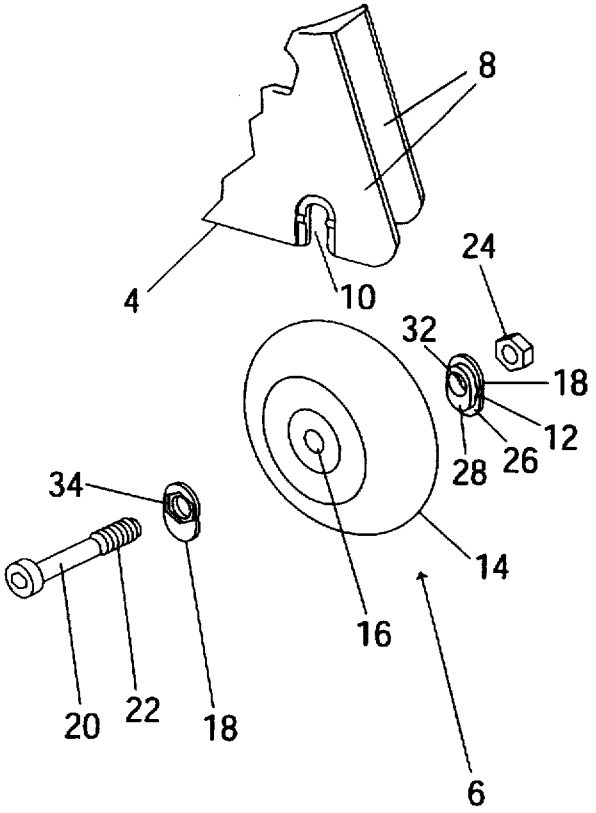
FIGS. 5*a*–5*d* are perspective views of the wheel fastening systems of FIGS. 1–4 where the safety recesses and protrusions, and the indexing recesses and tabs, are formed on opposite elements.
Figure 5B:
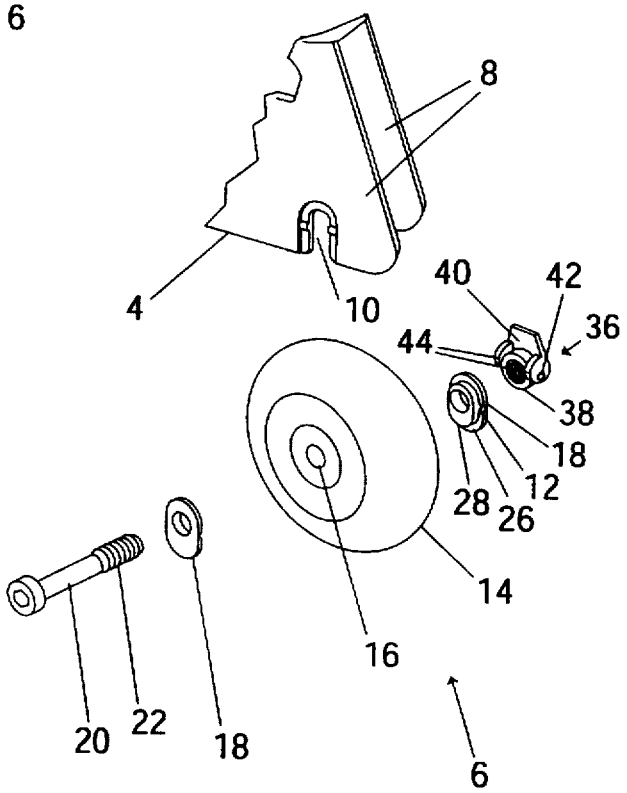
Figure 5C:
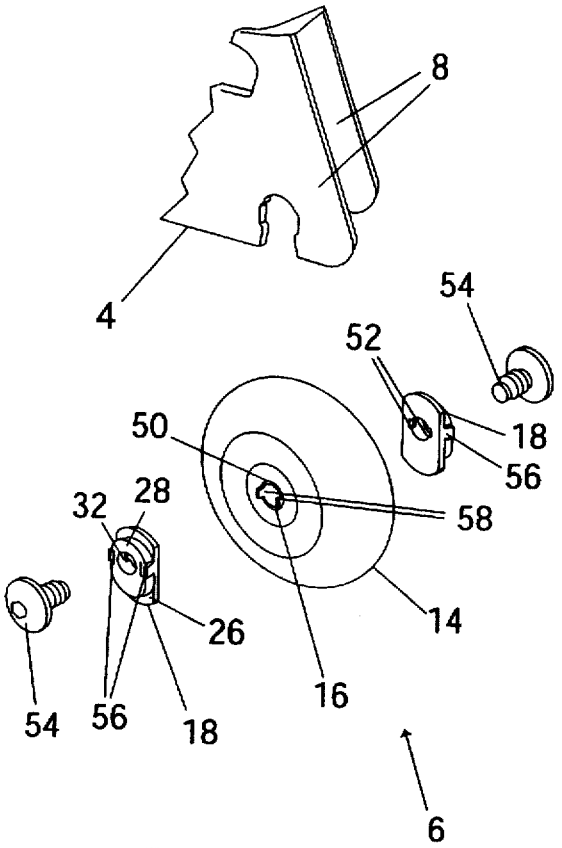
Figure 5D:
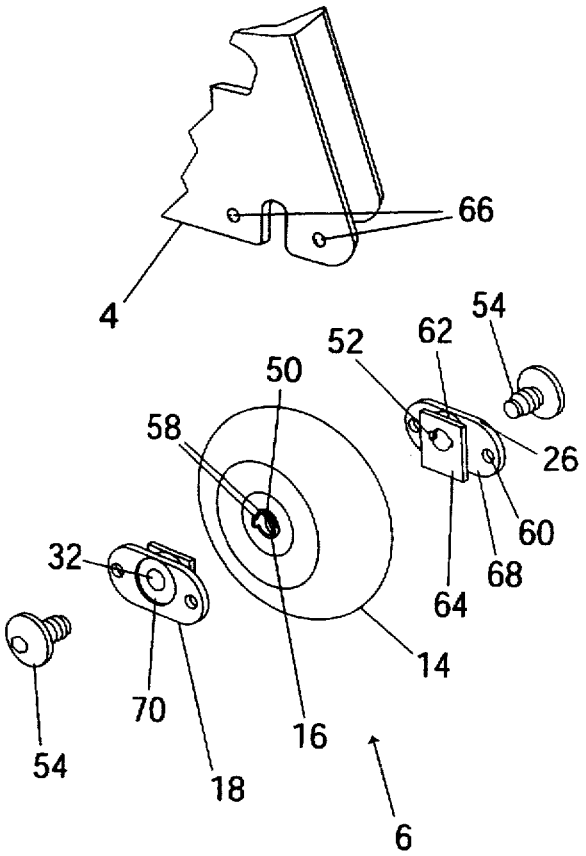

It should be noted that it is within the scope of the present invention to swap the locations of mated protrusions and recesses, and mated indexing tabs and indexing recesses, for the four embodiments described above. For example, safety protrusions 30 can be formed on frame 4 and safety recesses 12 can be formed on frame spacers 18, as illustrated in FIGS. 5*a*–5*b*. Further, indexing tabs 58 can be formed on wheel spacers 50 and indexing recesses can be formed on frame spacers 18, as illustrated in FIG. 5*c*. Lastly, the safety protrusions 66 can be formed on frame 4 and safety recesses 60 can be formed on flange arms 68, as illustrated in FIG. 5*d*.

It should also be noted that it is within the scope of the present invention to use various combinations of bolts, frame and frame spacer designs that are described above. For example, axle bolts 54 and threaded wheel spacers 50 of FIG. 3*a* can be used with the frame spacers 18 and safety recesses 12 of FIG. 1*a*. Alternately, the axle bolts 20 and cam nuts 36 of FIG. 2*a* can be used with the frame spacers 18 and safety recesses 60 of FIG. 4*a*.

Frame spacers 18 can be made of materials such as nylon, aluminum, steel, or any other strong material. Resilient materials, such as polypropylene, polyethylene, nylon, or spring steel can be used for forming the snap protrusions 56. Plastics, including nylon, ABS and polyethylene are ideal for forming frame spacers 18 of FIG. 4 because flange arms 68 need to be resilient for removing and inserting frame spacers 18 into slots 10 and because the frame spacers can be molded in plastic as a single part.

Figure 6:
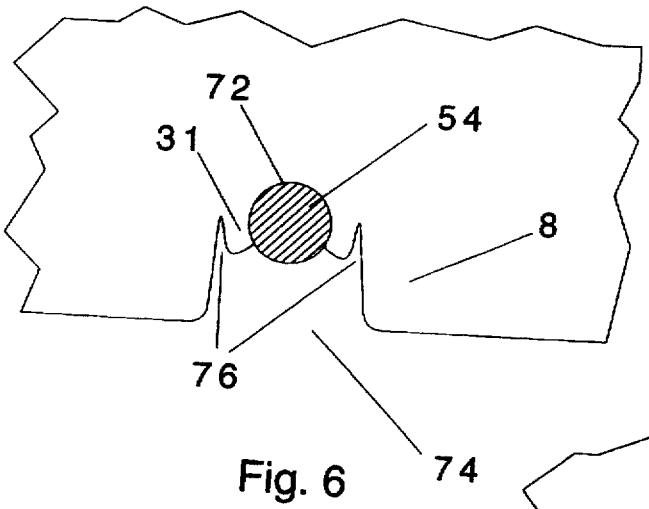
FIG. 6 is a side view of a snap recess formed in the top end of the slot.

FIG. 6 illustrates a fifth embodiment of the present invention. In this embodiment, a wheel module 6 does not include a frame spacer 18. Instead, a snap recess 72 is located in the top of each of the slots 74 in the frame wall 8. The snap recess 72 has a diameter approximately equal to the diameter of bolts 54 (or a single bolt 20). A pair of indentations 76 are formed on either side of recesses 72 such that recess 72 expands and contracts to allow bolts 54 to snap into and out of recess 72. With the wheel module 6 mounted in the frame, the snap recesses 72 engage around the axle bolts 54, thereby preventing the wheel module 6 from falling out of the frame 4 should the axle bolts 54 accidentally loosen.

To intentionally remove the wheel module 6 from the frame 4, the axle bolts 54 are loosened such that wheel module 6 may then be pulled vertically downward out of the slots 74. When the wheel module 6 is pulled out, the snap recesses 72 flex away from the axle bolts 54 thereby allowing the wheel module 6 to be removed. To re-mount the wheel module 6 to the frame 4, the wheel module 6 is pushed into the slots 74 thereby engaging the snap recesses 72 around axle bolts 54, and the axle bolts 54 are tightened into the wheel spacer 50.

Figure 7:
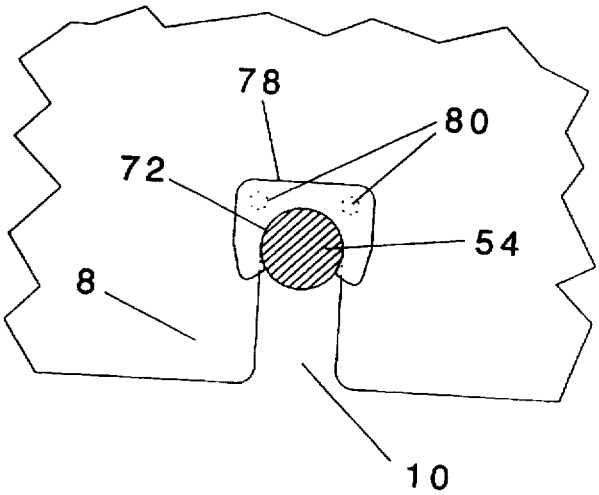
FIG. 7 is a side view of a snap member that forms the snap recess.

FIG. 7 illustrates a sixth embodiment of the present invention, where snap recesses 72 are formed by snap members 78 which are fastened to the frame wall 8 adjacent slots 10. Snap members 78 are secured to the frame 4 by pins 80 (shown in phantom), or alternately by any other conventional means, such as adhesives etc. With the wheel module 6 mounted in the frame 4, the snap members 78 engage around the axle bolts 54, thereby preventing axle bolts 54 from falling out of slots 10 should they accidentally loosen.

To intentionally remove the wheel module 6 from the frame 4, the axle bolts 54 are loosened so that wheel module 6 can be pulled vertically downwards out of the slots 10. When the wheel module 6 is pulled out, the snap members 78 flex away from the axle bolts 54 thereby allowing the wheel module 6 to be removed. To re-mount the wheel module 6 to the frame 4, the wheel module 6 is pushed vertically upwards into the slots 10 thereby engaging the snap members 78 around the axle bolts 54, and then axle bolts 54 are tightened into the wheel spacer 50.

Figure 8A:
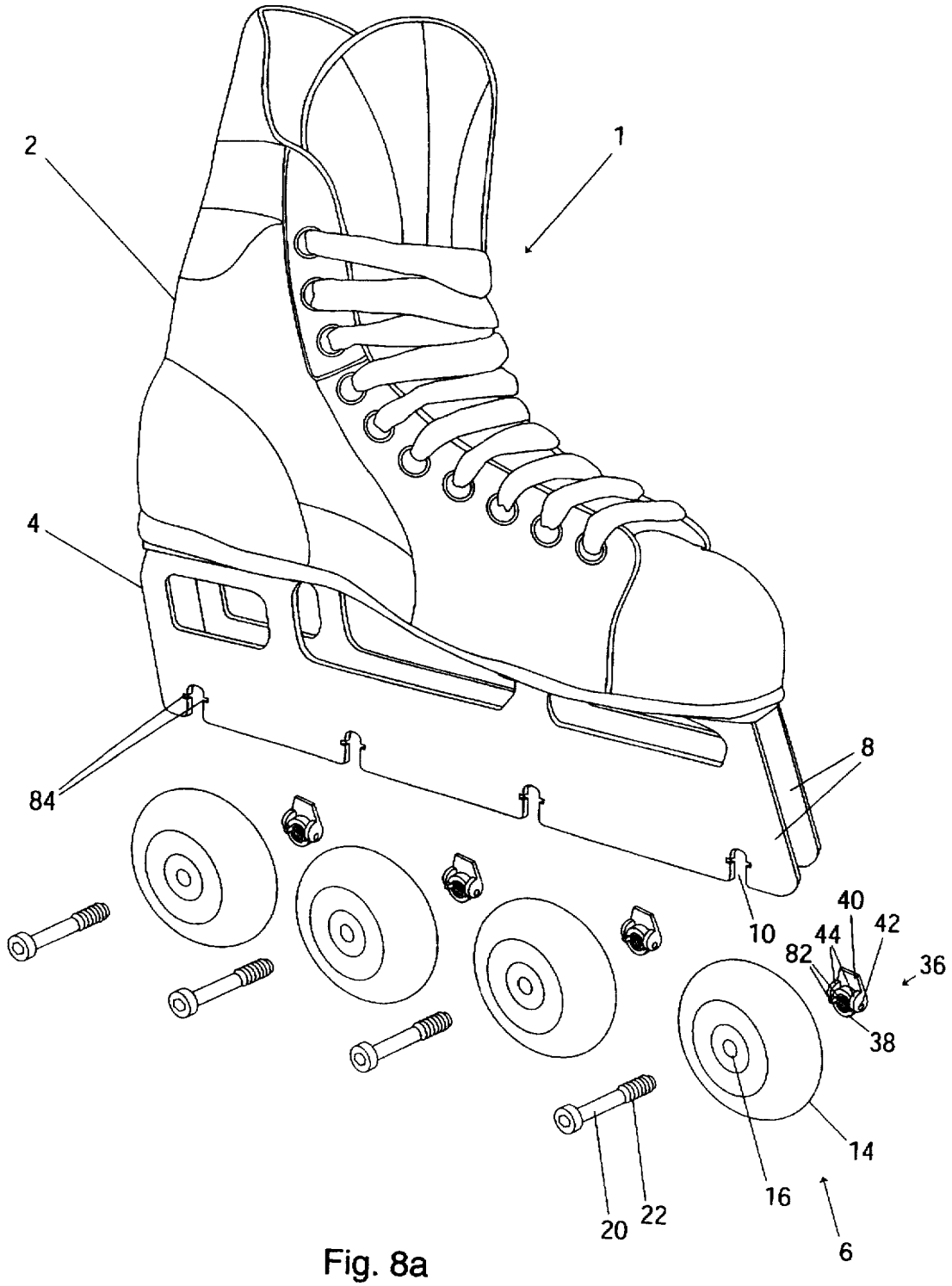
FIGS. 8*a*–8*c* are exploded perspective views of the wheel fastening system with safety protrusions formed on the cam nuts.
Figure 8B:
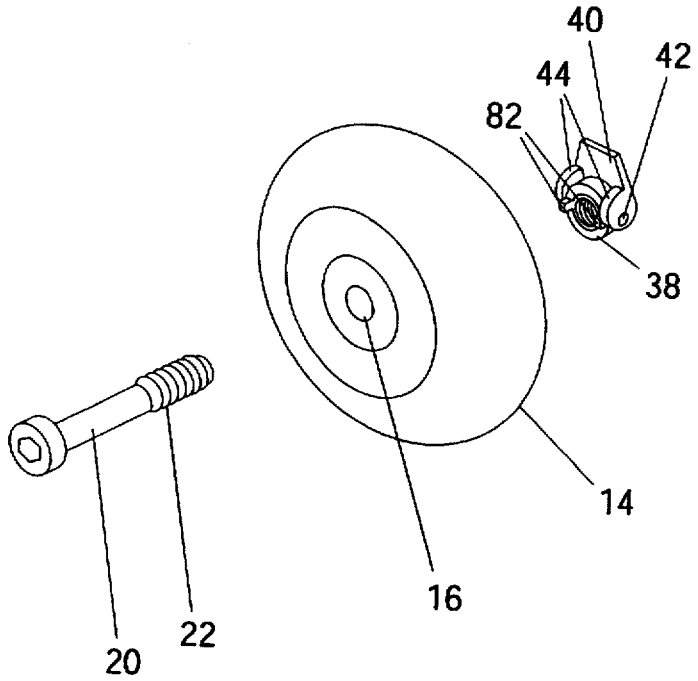
Figure 8C:
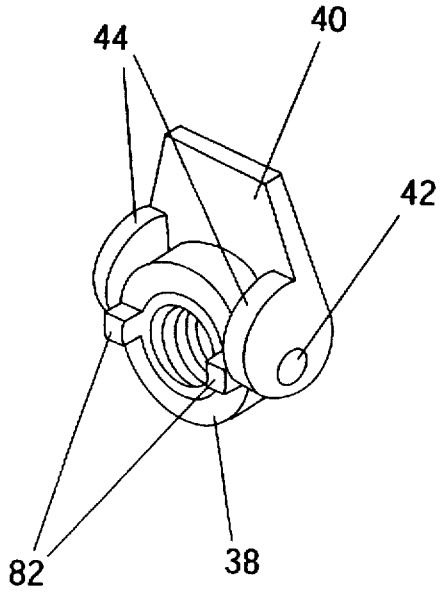
Figure 8D:
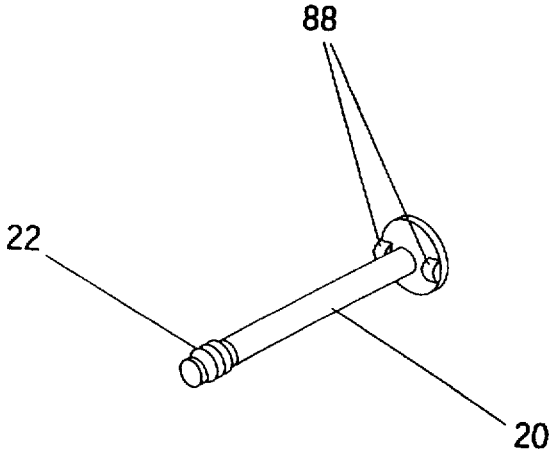
FIG. 8*d* is a perspective view of the axle bolt with safety protrusions formed on the bolt head.
Figure 8E:
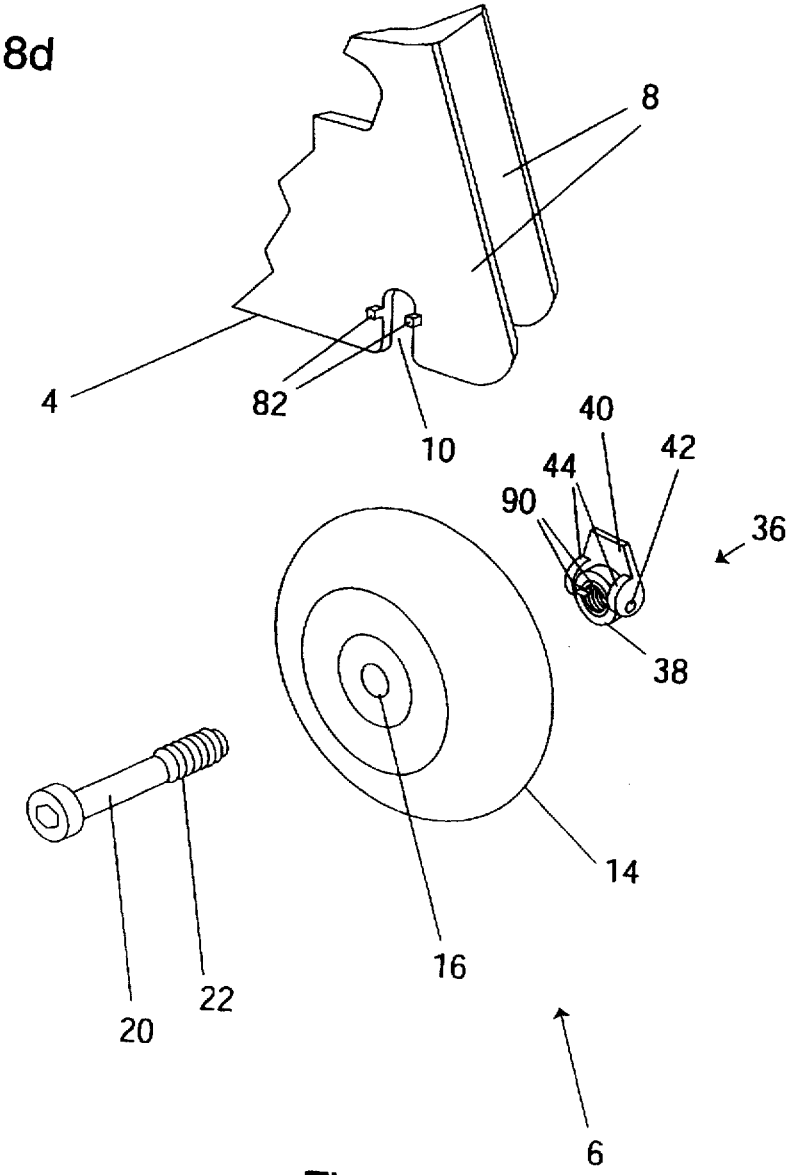
FIGS. 8*e* is an exploded perspective view of the wheel fastening system with safety recesses formed on the cam nuts and safety protrusions formed on the frame walls.

FIGS. 8*a*–8*c* illustrate a seventh embodiment of the present invention, where accidental disengagement of the wheel module 6 from frame 4 may be prevented by protrusions 82 located on the cam nut 36 which mate into safety recesses 84 located in the frame walls 8 near frame slots 10. The safety protrusions 82 extend farther from the threaded portion of cam nut 38 than cam lobes 44 in order to prevent rotation of cam nut 36, as well as to retain the wheel module 6 in slot 10 in the event the cam lever accidentally disengages. It should be noted that safety protrusions 88 could alternately be formed on the head of the axle bolt 20 instead of the on the cam nut 38, as illustrated in FIG. 8*d*. Further, recesses 90 could alternately be formed on the cam nut 38 or the head of bolt 20, and the protrusions 82 could be formed on the walls 8 of frame 4, as illustrated in 8*e*. Lastly, the nut need not be a cam nut, as any nut engaged on the bolt having a protrusion or recess will suffice for this embodiment.

It is to be understood that the present invention is not limited to the embodiments described above and illustrated herein, but encompasses any and all variations falling within the scope of the appended claims.

What is claimed is:

1. A wheel fastening system for rotatably securing wheels to a shoe portion of an in-line skate, comprising:

a frame for attaching to a bottom surface of the shoe portion and including a pair of first and second opposing walls that depend from said shoe portion, each of said walls having a bottom edge, a pair of opposing slots one of each being formed in said first and second walls respectively, said slots having an open end at said bottom edges, each of said walls having a side surface with one of a safety recess and a safety protrusion formed therein adjacent said slots;

a first and a second frame spacer each having a plug with a flange portion extending therefrom, said plug having a through-hole formed therethrough and being dimensioned to insert into said slot, each of said first and second frame spacers having the other of said safety recess and said safety protrusion formed on said flange portion, each of said frame spacers inserted into said slots such that said safety protrusion removably engages said safety recess to removably secure said first and second spacers to said frame and to prevent movement of the frame spacers toward said bottom edges;

a wheel having an axle hole formed through its center of rotation positioned between said pair of slots; and an axle means received through said axle hole of said wheel and said through-holes of said frame spacers for rotatably and removably securing said wheel between said first and second walls of said frame.

2. The wheel fastening system of claim 1, further comprising:

a collar formed on each of said plugs that has a width larger than the width of said slots, said through-hole extending through said collar, wherein when each of said plugs is inserted in said slots, said flange portion abuts one side of said wall and said collar abuts the other side of said wall.

3. The wheel fastening system of claim 1 wherein said plugs are non-cylindrical in shape, and said through-holes are eccentrically formed relative to said plugs.

4. The wheel fastening system of claim 3 further comprising:

a hexagonal recess formed on at least one of said frame spacers, said hexagonal recess being centered around said through-hole; and said axle means including a threaded hexagonal nut positioned in said hexagonal recess, and a bolt having a threaded shaft that extends through said through-holes and said axle hole and said hexagonal recess, wherein said nut engages said threads of said bolt.

5. The wheel fastening system of claim 3 wherein said axle means includes:

a bolt having a shaft that extends through said through-holes and said axle hole; and a cam nut that engages said shaft and includes a lever pivotally mounted on a cam pin protruding from said cam nut, said cam nut having a side that abuts one of said frame spacers when said cam nut has engaged said shaft, said lever pivots between a flat closed position and an open extended position and has at least one cam lobe that protrudes beyond said side of said cam nut when said lever is in said flat closed position.

6. A wheel fastening system for rotatably securing wheels to a shoe portion of an in-line skate, comprising:

a frame for attaching to a bottom surface of the shoe portion and including a pair of first and second opposing walls that depend from said shoe portion, each of said walls having a bottom edge, a pair of opposing slots one of each being formed in said first and second walls respectively, said slots having an open end at said bottom edges, each of said walls having a first engagement means formed therein adjacent said slots;

a first and a second frame spacer each having a plug with a flange portion extending therefrom, said plug having a through-hole formed therethrough and being dimensioned to insert into said slot, each of said first and second frame spacers having a second engagement means formed on said flange portion, said frame spacers inserted into said slots such that said first engagement means removably engages said second engagement means for removably securing said first and second spacers to said frame;

a wheel having an axle hole formed through its center of rotation positioned between said pair of slots;

an axle means received through said axle hole of said wheel and said through-holes of said frame spacers for rotatably and removably securing said wheel between said first and second walls of said frame;

said first engagement means is one of a safety recess and a safety protrusion;

said second engagement means is the other of said safety recess and said safety protrusion;

said plugs are non-cylindrical in shape, and said through-holes are eccentrically formed relative to said plugs;

a wheel spacer disposed inside said axle hole of said wheel having a threaded wheel spacer hole located at the center of rotation of said wheel and having a pair of side surfaces facing said frame spacers, one of an indexing recess and an indexing tab is formed in each of said side surfaces of said wheel spacer;

a collar formed on an end of each of said plugs that has a width larger than the width of said slots, said through-hole extending through said collar, each of said collars having the other of said indexing recess and indexing tab formed thereon, wherein when each of said plugs is inserted in said slots, said flange portion abuts one side of said wall and said collar abuts the other side of said wall, and wherein said indexing recesses engage said indexing tabs to prevent rotation of said wheel spacer; and said axle means including a pair of bolts each of which having a threaded shaft that extends through one of said through-holes and engages the threads of said wheel spacer.

7. A wheel fastening system for rotatably securing wheels to a shoe portion of an in-line skate, comprising:

a frame for attaching to a bottom surface of the shoe portion and including a pair of first and second opposing walls that depend from said shoe portion, each of said walls having a bottom edge, a pair of opposing slots one of each being formed in said first and second walls respectively, said slots having an open end at said bottom edges and a safety recess formed therein;

a first and a second frame spacer dimensioned to insert into said slots and including a through-hole formed therethrough, each of said frame spacers having a protrusion that extends therefrom such that when said frame spacers are inserted into said slots, said protrusion removably engages said safety recess to prevent movement of the frame spacers toward said bottom edges;

a wheel having an axle hole formed through its center of rotation positioned between said pair of slots; and an axle means received through said axle hole of said wheel and said through-holes of said frame spacers for rotatably and removably securing said wheel between said first and second walls of said frame.

8. A wheel fastening system for rotatably securing wheels to a shoe portion of an in-line skate, comprising:

a frame for attaching to a bottom surface of the shoe portion and including a pair of first and second opposing walls that depend from said shoe portion, each of said walls having a bottom edge, a pair of opposing slots one of each being formed in said first and second walls respectively, said slots having an open end at said bottom edges and a safety recess formed therein;

a first and a second frame spacer dimensioned to insert into said slots and including a through-hole formed therethrough; each of said frame spacers having a protrusion that extends therefrom such that when said frame spacers are inserted into said slots, said protrusion removably engages said safety recess;

a wheel having an axle hole formed through its center of rotation positioned between said pair of slots; and an axle means received through said axle hole of said wheel and said through-holes of said frame spacers for rotatable and removably securing said wheel between said first and second walls of said frame;

wherein said protrusion is a flexible snap protrusion.

9. The wheel fastening system of claim 8 wherein each of said frame spacers include a plug with a flange portion extending therefrom, said plug having said through-hole formed therethrough and being dimensioned to insert into said slot, said snap protrusion extending from one of said plug and said flange portion.

10. The wheel fastening system of claim 9 wherein said plugs are non-cylindrical, and said through-holes are eccentrically formed relative to said plugs.

11. The wheel fastening system of claim 10 further comprising:

a wheel spacer disposed inside said axle hole of said wheel having a threaded wheel spacer hole located at the center of rotation of said wheel and having a pair of side surfaces facing said frame spacers, one of an indexing recess and an indexing tab is formed in each of said side surfaces of said wheel spacer;

each of said frame spacers having the other of said indexing recess and indexing tab positioned thereon such that said indexing tabs engage said indexing recesses to prevent rotation of said wheel spacer; and said axle means including a pair of bolts each of which having a threaded shaft that extends through one of said through-holes and engages the threads of said wheel spacer.

12. A wheel fastening system for rotatably securing wheels to a shoe portion of an in-line skate, comprising:

a frame for attaching to a bottom surface of the shoe portion and including a pair of first and second opposing walls that depend from said shoe portion, each of said walls having a bottom edge, a pair of opposing slots one of each being formed in said first and second walls respectively, said slots having an open end at said bottom edges, at least one of said walls having one of a safety recess and a safety protrusion formed therein adjacent said slots;

a wheel having an axle hole formed through its center of rotation positioned between said pair of slots;

a bolt having a bolt head and a threaded shaft that extends through said slots and said axle hole; and a threaded cam nut that engages said threads of said bolt and includes a lever pivotly mounted on a cam pin protruding from said cam nut, said cam nut having a side that abuts one of said walls when said cam nut has engaged said shaft, said lever pivots between a flat closed position and an open extended position and has at least one cam lobe that protrudes beyond said side of said cam nut when said lever is in said flat closed position; wherein the other of said safety recess and said safety protrusion is formed on said cam nut positioned to engage said one of said safety recess and said safety protrusion on said one wall to removably secure said wheel to said frame and to prevent movement of said bolt toward said bottom edges.

13. An in-line skate, comprising:

a shoe portion having a bottom surface;

a frame attached to said bottom surface of said shoe portion and including a pair of first and second opposing walls that depend from said shoe portion, each of said walls having a bottom edge, a pair of opposing slots one of each being formed in said first and second walls respectively, said slots having an open end at said bottom edges, each of said walls having a side surface with one of a safety recess and a safety protrusion formed therein adjacent said slots;

a first and a second frame spacer each having a plug with a flange portion extending therefrom, said plug having a through-hole formed therethrough and being dimensioned to insert into said slot, each of said first and second frame spacers having the other of said safety recess and said safety protrusion formed on said flange portion, each of said frame spacers inserted into said slots such that said safety protrusion removably engages said safety recess to removably secure said first and second spacers to said frame and to prevent movement of the frame spacers toward said bottom edges;

a wheel having an axle hole formed through its center of rotation positioned between said pair of slots; and an axle means received through said axle hole of said wheel and said through-holes of said frame spacers for rotatably and removably securing said wheel between said first and second walls of said frame.

14. The in-line skate of claim 13, further comprising:

a collar formed on each of said plugs that has a width larger than the width of said slots, said through-hole extending through said collar, wherein when each of said plugs is inserted in said slots, said flange portion abuts one side of said wall and said collar abuts the other side of said wall.

15. An in-line skate comprising:

a shoe portion having a bottom surface;

a frame attached to said bottom surface of said shoe portion and including a pair of first and second opposing walls that depend from said shoe portion, each of said walls having a bottom edge, a pair of opposing slots one of each being formed in said first and second walls respectively, said slots having an open end at said bottom edges and safety recesses formed therein;

a first and a second frame spacer dimensioned to insert into said slots and including a through-hole formed therethrough, each of said frame spacers having a pair of protrusions that extend therefrom such that when said frame spacers are inserted into said slots said protrusions removably engage said safety recesses to prevent movement of the first and second frame spacers toward said bottom edges;

a wheel having an axle hole formed through its center of rotation positioned between said pair of slots; and an axle means received through said axle hole of said wheel and said through-holes of said frame spacers for rotatably and removably securing said wheel between said first and second walls of said frame.

16. An in-line skate, comprising:

a shoe portion having a bottom surface;

a frame attached to said bottom surface of said shoe portion and including a pair of first and second opposing walls that depend from said shoe portion, each of said walls having a bottom edge, a pair of opposing slots one of each being formed in said first and second walls respectively, said slots having an open end at said bottom edges, at least one of said walls having one of a safety recess and a safety protrusion formed therein adjacent said slots;

a wheel having an axle hole formed through its center of rotation positioned between said pair of slots;

a bolt having a bolt head and a threaded shaft that extends through said slots and said axle hole; and a threaded cam nut that engages said threads of said bolt and includes a lever pivotly mounted on a cam pin protruding from said cam nut, said cam nut having a side that abuts one of said walls when said cam nut has engaged said shaft, said lever pivots between a flat closed position and an open extended position and has at least one cam lobe that protrudes beyond said side of said cam nut when said lever is in said flat closed position; wherein the other of said safety recess and said safety protrusion is formed on said cam nut positioned to engage said one of said safety recess and said safety protrusion on said one wall to removably secure said wheel to said frame and to prevent movement of said bolt toward said bottom edges.

* * * * *